US006526706B1

(12) United States Patent
Fowler

(10) Patent No.: US 6,526,706 B1
(45) Date of Patent: Mar. 4, 2003

(54) BEACH STAIRWAY

(75) Inventor: William J. Fowler, Emerald Isle, NC (US)

(73) Assignee: Creative Homebuilding Inc., Emerald Isle, NC (US)

( * ) Notice: Subject to any disclaimer, the term of this patent is extended or adjusted under 35 U.S.C. 154(b) by 0 days.

(21) Appl. No.: 09/850,277

(22) Filed: May 7, 2001

Related U.S. Application Data

(60) Provisional application No. 60/202,693, filed on May 8, 2000.

(51) Int. Cl.[7] ..... E04F 11/00; E04F 19/10

(52) U.S. Cl. ..... 52/182; 405/218; 405/220; 405/4; 182/88; 182/98; 182/115; 182/127; 14/71.1; 14/18; 14/69.5; 14/2.4

(58) Field of Search ..... 52/182; 405/218, 405/220, 4; 182/88, 98, 115, 127; 14/71, 71 R, 18, 71.1, 69.5, 2.4

(56) References Cited

U.S. PATENT DOCUMENTS

| | | | | | |
|---|---|---|---|---|---|
| 3,875,707 | A | * | 4/1975 | Horn | 52/184 |
| 3,953,980 | A | * | 5/1976 | Bennett | 61/48 |
| 4,068,770 | A | | 1/1978 | Boehringer | |
| 4,107,932 | A | | 8/1978 | Cantrell | |
| 4,139,079 | A | | 2/1979 | Clark | |
| 4,212,564 | A | * | 7/1980 | Kay | 405/218 |
| 4,679,657 | A | * | 7/1987 | Bennett et al. | 182/113 |
| 4,852,688 | A | | 8/1989 | Strohmeyer, Sr. | |
| 5,024,291 | A | | 6/1991 | Price | |
| 5,058,339 | A | * | 10/1991 | Krstovic | 52/187 |
| 5,067,428 | A | * | 11/1991 | Dickerson et al. | 114/230 |
| 5,090,842 | A | * | 2/1992 | Montgomery | 403/3 |
| 5,123,372 | A | | 6/1992 | Kobayashi et al. | |
| 5,152,245 | A | | 10/1992 | Olsen | |
| 5,282,435 | A | * | 2/1994 | Chapman | 114/263 |
| 5,626,440 | A | | 5/1997 | Greene, Jr. et al. | |
| 5,971,105 | A | | 10/1999 | Jacobson | |
| 6,256,946 | B1 | * | 7/2001 | Kennedy et al. | 52/183 |
| 6,374,562 | B1 | * | 4/2002 | Crowly | 52/506.01 |

FOREIGN PATENT DOCUMENTS

| | | | | |
|---|---|---|---|---|
| JP | 6-180052 | * | 12/1992 | E04F/11/02 |
| JP | 6-180051 | * | 6/1994 | E04F/11/02 |

* cited by examiner

*Primary Examiner*—Lanna Mai
*Assistant Examiner*—Chi Q. Nguyen
(74) *Attorney, Agent, or Firm*—MacCord Mason PLLC

(57) ABSTRACT

A highly stable beach access stairway is described that includes steps constructed of first and second parallel stringers with a plurality of treads extending between the stringers; upper, intermediate and lower support posts upon which the stringers are mounted; upper, intermediate and lower cable attachment rods extending through the support posts and stringers; a plurality of sand anchors positionable at spaced distances from the top and sides of the steps, and cables that connect the anchors to the attachment rods adjacent the inner sides of the stringers. The top anchor is connected to the upper and intermediate rods, while the side anchors are attached to the inner face of the stringer on the opposite side of the steps from the anchor. A bottom anchor may also be positioned beneath the steps and attached to the intermediate and lower rods.

17 Claims, 4 Drawing Sheets

BEACH STAIRWAY

This application claims the priority of provisional patent application Serial No. 60/202,693, filed May 8, 2000.

SUMMARY OF THE INVENTION (1) Field of the Invention

The present invention relates generally to a stairway that can be used to provide access to a beach from the top of a dune, and in particular to a beach stairway that can form a permanent structure, or which can be readily detached and moved.

(2) Description of the Prior Art

Due to water action, many beaches are comprised of a raised inland area, herein referred to as a dune, that has an upper surface that is substantially higher than the beach surface, resulting in a significant embankment or drop-off from the top of the dune to the beach surface. In order to gain access to the beach from the dune, the common practice is to construct a stairway that extends from the top of the dune to the beach surface. Normally, this stairway is a permanent construction, with the upper end of the stairway being connected to a horizontal walkway that extends inland across the dune, and posts at the beach level that are inserted into the sand.

These beach stairways are often damaged and destroyed during storms or other adverse weather that causes the sand around the stairway to shift, often dramatically. To address this problem, U.S. Pat. No. 5,626,440 to Greene et al. describes a beach stairway that can be quickly detached from a support base in the event of adverse weather, and stored until the event is over. The stairway can then be replaced, or positioned at a new location in the event of a major shift on the topography.

Basically, the Greene et al. stairway is comprised of a hollow walkway that is tiltable mounted on support pylons, with steps that are slidable within the walkway section. When positioned for use, the walkway section is horizontally positioned on the dune surface, while the steps extend from the forward end of the walkway and downward to the beach. When the stairway is to be moved, the steps are slid into the walkway section, and the stairway is detached from the support.

While the Greene et al. stairway describes one type of stairway that can be detached to avoid damage during adverse weather, it does not address the need for a beach stairway that can serve as a highly stable stairway, providing a permanent structure, if desired, or which can be readily disassembled for removal to a different area. Stairway structures to date have not provided this desired stability combined with the ease of assembly and disassembly.

SUMMARY OF THE INVENTION

The present invention is directed to a beach stairway for providing access to a beach surface from a higher dune surface, which combines high stability with quick installation and removal without the need for elaborate tools. Basically, the beach stairway of the present invention is comprised of inclined steps with opposed sides and a top end, upright posts to support the steps, a plurality of sand anchors positionable from the top and sides of the steps, and cables that extend from the steps for attachment to each of the anchors, thereby securely holding the steps in the desired position during use.

The steps include first and second parallel stringers, a plurality of treads extending between the stringers. The treads are evenly spaced and may be attached with tread cleats that are secured to the inner faces of the stringers, e.g., by screws, with the treads being attached to the upper surfaces of the tread cleats. The stringers and treads are constructed of pressure treated lumber, preferably impregnated to a minimum retention of 0.40 lbs. per cubic foot. The dimensions of the stringers and treads will depend upon the length of the steps. However, stringers will normally constructed of 2×6 or 2×8 lumber depending upon the vertical distance between the treads, with 2×8 stringers preferably being used for a rise of 7.5" or more. The treads will normally be of 2×12 lumber, although 2×10 lumber can be used.

The sand anchors are adapted to securely anchor the steps to the sand, and are generally comprised of an elongated member, such as a rod or tube, which is desirably about 5 feet in length. The lower end on the elongated member may include an auger blade to facilitate insertion and locking into the sand. The upper end of the anchor may include an eyelet through which the cables are inserted.

Placement of the sand anchors relative to the steps, and the manner in which the sand anchors are attached to the steps are of considerable importance in producing the required stability for the stairway. The anchors include a top anchor that is positioned at a distance of preferably from about 3 to 6 feet beyond the top of the steps, and side anchors on each side of the steps that are positioned at a distance of preferably from about 3 to about 6 feet from the outer faces of the stringers, and preferably slightly above the top end of the stringers.

In order to attach the cables to the steps, and to secure the parts of the stairway together, a horizontal threaded rod extends through each pair of upright posts and the attached stringers. Washers and nuts are positioned on the rod on the outside of each post and the inside of each stringer. Cables are attached to the rods on the inside of each stringer by looping the end of the cable around the rod and securing the cable against the stringer by tightening the interior nuts against the cable and stringers.

When being mounted between a dune and a beach surface, side anchors are inserted into the sand at a spaced distance on either side of the steps at vertical levels that are preferably approximately equal to, or slightly above, the top of the stairs. A top anchor is inserted into the dune at a spaced distance from the top end of the steps. Optionally, a bottom anchor can be positioned beneath the steps near the lower end of the steps.

The steps are secured to the anchors with cables, which may be either galvanized or of stainless steel, that extend from the anchors to the horizontal rods. The top anchor is attached with cables that extend from the top anchor to upper and intermediate rods adjacent the inner sides of the stringers. Each side anchor is attached with cables to the upper, intermediate and lower rods adjacent the inner side of the stringer that is on the opposite side of the steps from the anchor being attached.

That is, the left side anchor is attached to the steps with upper, intermediate and lower side cables that extend from the left anchor to the upper, intermediate and lower rods, respectively, with the ends of the cables being held against the inner face of the right stringer. Similarly, the right side anchor is attached to the steps with upper, intermediate and lower side cables that extend from the right side anchor to the upper, intermediate and lower rods, respectively, with the ends of the cables being held against the inner face of the left stringer.

In order to provide even higher stability to the bottom section to the stairs, particularly when sand is washed away, the stairway may also include a bottom anchor that is positioned beneath the stairs between the stringers, and between the intermediate rod and lower rods. This bottom anchor can be secured to at least one of the rods, and preferably to the intermediate and lower rods by additional cables that extend from the bottom anchor to the ends of the lower rod, or both the lower and intermediate rods adjacent the inner faces of the stringers.

In instances where the stairway will be positioned at a height of more that one foot above the ground, or where it is desired to facilitate ascending or descending the steps, the stairway may further include spaced, parallel railings that extend upwardly from the steps. Each railing includes a handrail, parallel to and generally above a stringer, with handrail supports joining the handrail and the steps.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
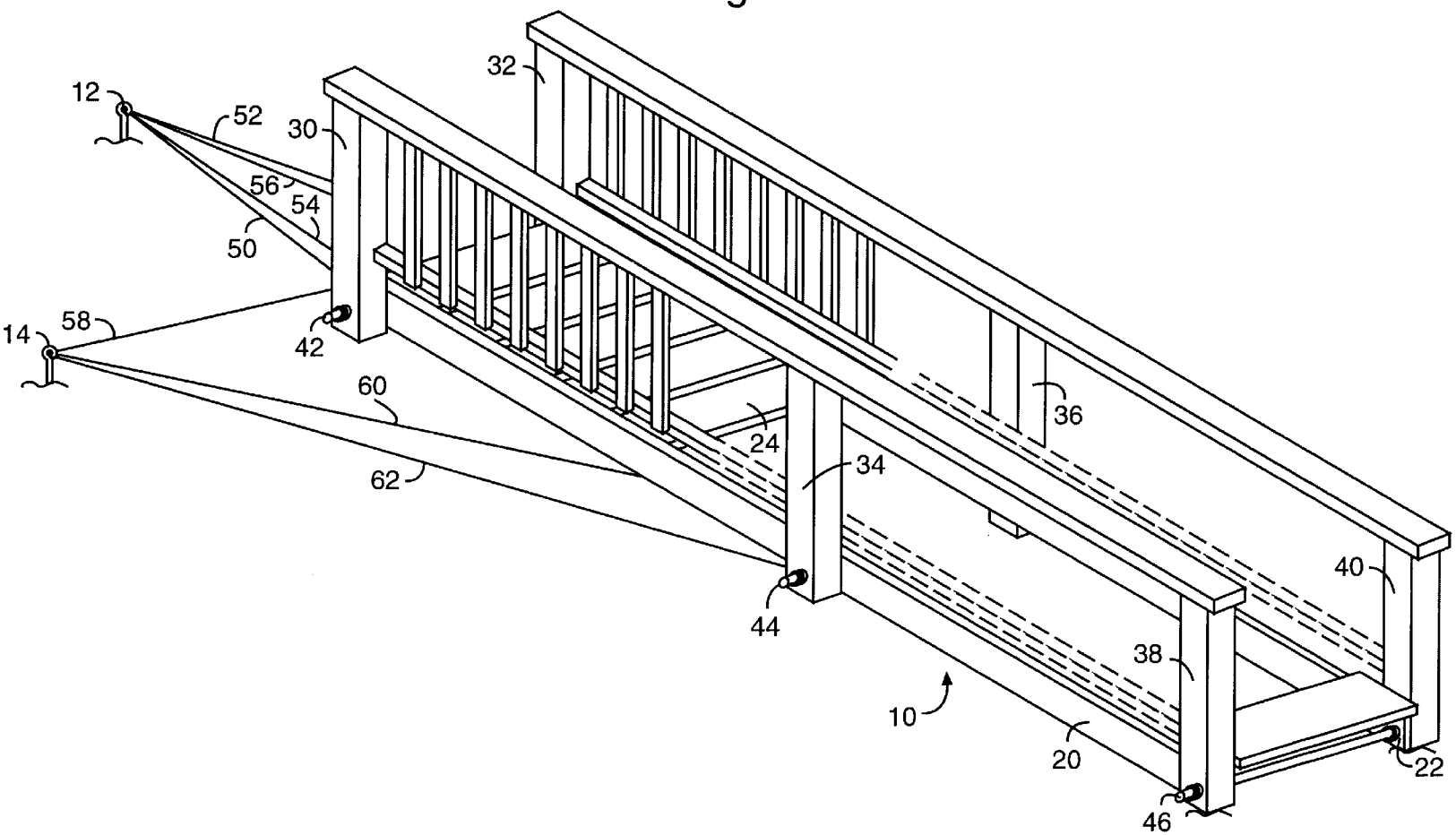
FIG. 1 is a perspective view of the beach stairway.
Figure 2:
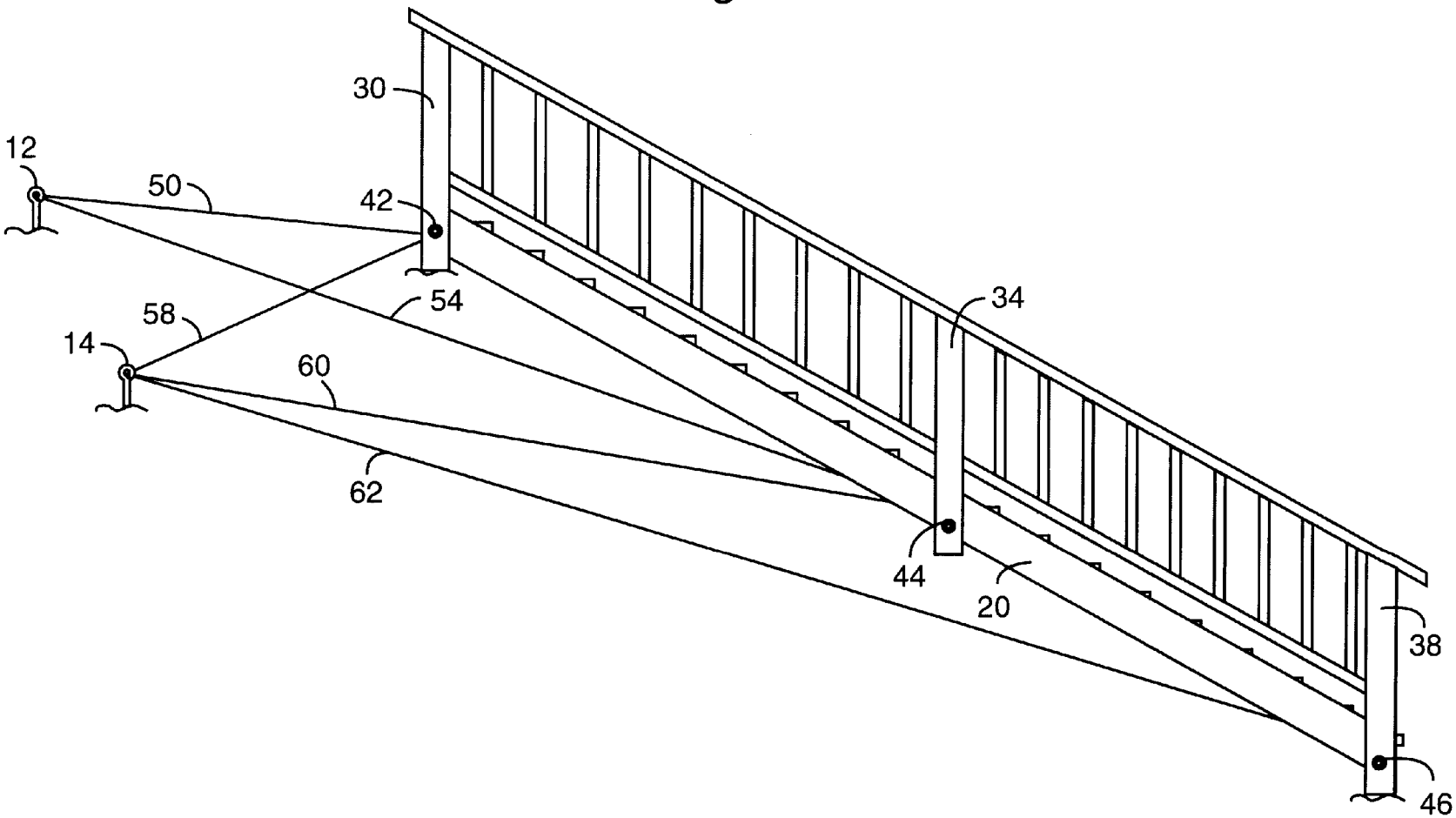
FIG. 2 is side view of the beach stairway.
Figure 3:
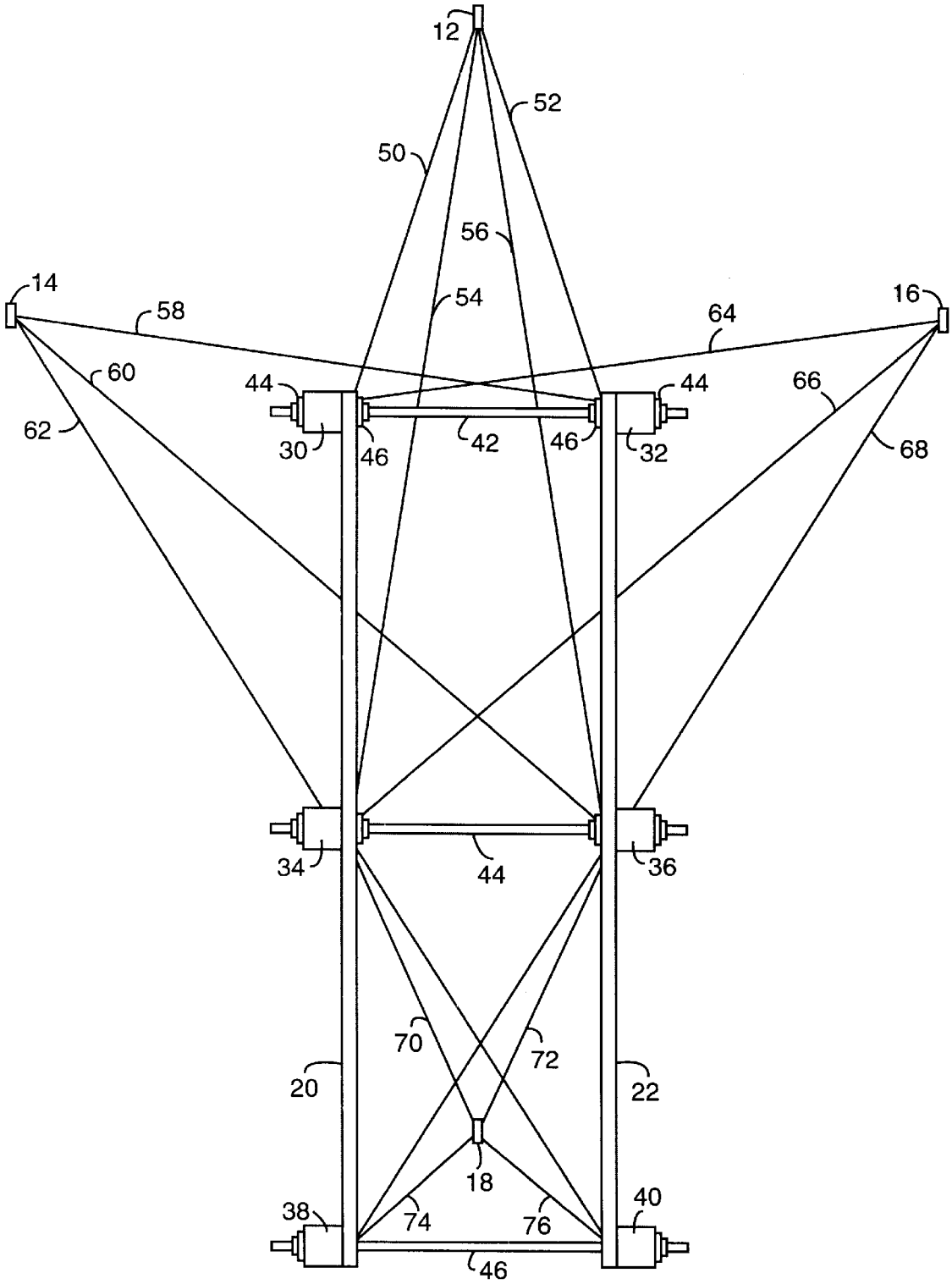
FIG. 3 is a top view of the beach stairway stringers and side posts, showing placement and attachment of the cables to the anchors.

As illustrated in FIGS. 1–3, the beach stairway of the present invention is comprised of step, generally 10, a top anchor 12, side anchors 14 and 16, and a bottom anchor 18 and various cables to be described. Step 10 is comprised of spaced, parallel stringers 20 and 22, and a plurality of equally spaced treads 24 extending between stringers 20 and 22. The exterior faces of stringers 20 and 22 are mounted to a pair of upper support posts 30 and 32, a pair of intermediate support posts 34 and 36, and a pair of lower support posts 38 and 40. The lower ends of the support posts may rest on the surface of the dune or beach area, but are not designed for insertion into the sand in the conventional manner of permanent stairways.

Upper support posts 30/32 are joined by threaded cable attachment rod 42 that extends horizontally through the posts and stringers 20 and 22. Rod 42 includes outer washer/nut assemblies 44 adjacent each post outer face, and inner washer/nut assemblies 46 adjacent the inner face of the stringers. Intermediate support posts 34/36 are joined by intermediate threaded cable attachment rod 44, and lower support posts 38/40 are joined by lower threaded cable attachment rod 46. Rods 44 and 46 also include inner and outer washer/nut assemblies like those of rod 42.

Top anchor 12 is attached to rod 42 adjacent the inner faces of stringers 20 and 22 by cables 50 and 52, respectively, and to rod 44 adjacent the inner faces of stringers 20 and 22 by cables 54 and 56, respectively. Side anchor 14 is connected to rods 42, 44 and 46 adjacent the inner face of stringer 22 by cables 58, 60 and 62, respectively. Side anchor 16 is connected to rods 42, 44, and 46 adjacent the inner face of stringer 20 by cables 64, 66 and 68, respectively.

Optional bottom anchor 18 is attached to rods 44 adjacent the inner faces of stringers 20 and 22 by cables 70 and 72, respectively, and connected to rod 46 adjacent the inner faces of stringers 20 and 22 by cables 74 and 76, respectively. In all instances, the ends of the cables are secured to the rods adjacent the inner faces of the stringers by looping the end of the cable around the rod and tightening washer/nut assembly 46.

Figure 4:
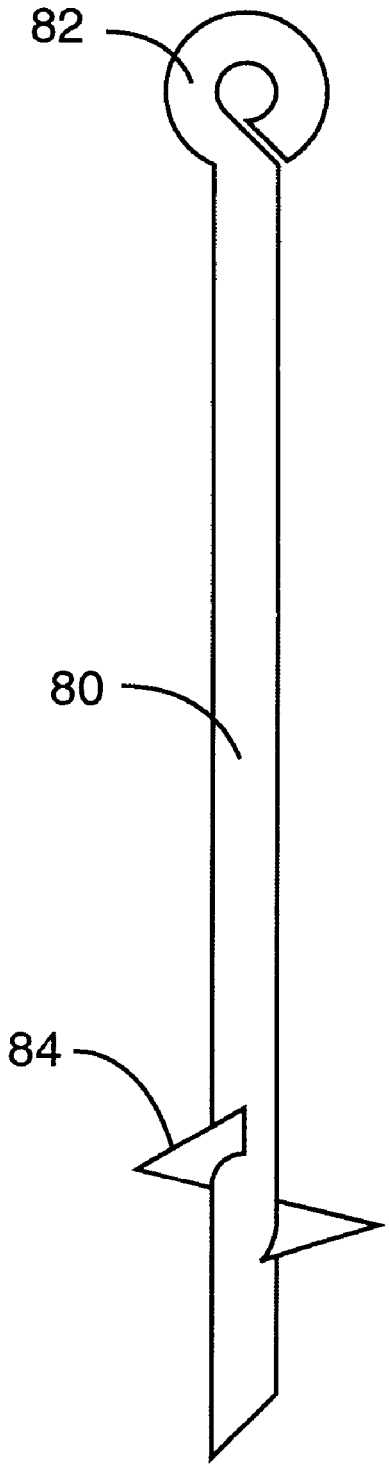
FIG. 4 is a detailed view of a sand anchor.

The sand anchors used in the present invention may be of various configurations. A typical sand anchor illustrated in FIG. 4 is comprised of a rod 80 having an eyelet 82 at its top end and an auger blade 84 at its lower end.

Once the cables have been attached and tightened, steps 10 are securely held in position on the sand dune, even when subjected to heavy use or weather as they serve as a means for climbing from the beach level to the upper level of land or dune, and for descending to the beach level. However, if desired, the stairway can be detached by simply disconnecting the cables.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A beach access stairway comprising:

a) steps including first and second parallel stringers with inner and outer faces, and a plurality of treads extending between said stringers, said steps having a top and opposed sides;

b) a first side sand anchor spaced at a distance from the outer face of said first stringer, and a second side sand anchor spaced at a distance from the outer face of said second stringer; and c) cables connecting said first anchor to adjacent the inner face of said second a stringer, and said second anchor to adjacent the inner face of said first stringer.

2. The stairway of claim 1, wherein each of said sand anchors is comprised of a elongated member having an auger blade at its bottom end and a cable eyelet at its top end.

3. The stairway of claim 1, further including upper, intermediate and lower pairs of support posts, said stringers having outer faces attached to said support posts.

4. The stairway of claim 1, further including upper, intermediate and lower cable attachment rods extending between said stringers, said cables being attached to said cable attachment rods.

5. The stairway of claim 1, further includes spaced, parallel railings extending upwardly from said steps.

6. The stairway of claim 1, including a top anchor spaced from the top of said steps.

7. The stairway of claim 1, wherein said stringers and treads are constructed of pressure impregnated wood.

8. A beach access stairway comprising:

a) steps having a top and sides, and including first and second parallel stringers having inner and outer faces, and a plurality of treads extending between said stringers, each stringer having outer and inner faces;

b) upper, intermediate and lower pairs of support posts having inner faces, the outer faces of said stringers being attached to the inner faces of said support posts;

c) upper, intermediate and lower cable attachment rods extending between said stringers;

d) a first side sand anchor spaced at a distance from the outer face of said first stringer, and a second side sand anchor spaced at a distance from the outer face of said second stringer; and e) cables connecting said first anchor to a cable attachment rod adjacent the inner face of said second stringer, and said second anchor to a cable attachment rod adjacent the inner face of said first stringer.

9. The stairway of claim 8, further including a top sand anchor positioned at spaced distance from the top of said steps, said top anchor being attached by cables to said upper and intermediate rods.

10. The stairway of claim 8, wherein said first side anchor is attached by cables to said upper, intermediate and lower rods adjacent the inner face of said second stringer, and said second side anchor is attached by cables to said upper, intermediate and lower rods adjacent the inner face of said first stringer.

11. The stairway of claim 8, further including a bottom anchor beneath said steps, said bottom anchor being attached by cables to at least one of said rods adjacent the inner faces of said stringers.

12. The stairway of claim 9, wherein said cable attachment rods are threaded rods with washer/nut assemblies adjacent the inner faces of said stringers to secure said cables to said rods.

13. A beach access stairway comprising:

a) steps with a top and sides including first and second parallel stringers, and a plurality of treads extending between said stringers, each stringer having outer and inner faces;

b) upper, intermediate and lower pairs of support posts having inner faces, the outer faces of said stringers being attached to the inner faces of said support posts;

c) upper, intermediate and lower cable attachment rods extending between said stringers;

d) a top sand anchor positioned at a spaced distance from the top of said steps;

e) a first side sand anchor positioned at a spaced distance from the outer face of said first stringer;

f) a second side sand anchor positioned at a spaced distance from the outer face of said second stringer; and g) cables connecting said top anchor to said upper and intermediate cable attachment rods adjacent the inner faces of said stringers, said first side anchor to said upper, intermediate and lower cable attachment rods adjacent the inner face of said second stringer, and said second side anchor to said upper, intermediate and lower cable attachment rods adjacent the inner face of said first stringer.

14. The stairway of claim 12, further including a bottom anchor beneath said steps, and cables connecting said bottom anchor to said intermediate and lower rods adjacent the inner faces of said stringers.

15. The stairway of claim 13, wherein said cable attachment rods are threaded rods with washer/nut assemblies adjacent the inner faces of said stringers to secure said cables to said rods.

16. The stairway of claim 13, wherein each of said sand anchors is comprised of a elongated member having a top end, and an eyelet adjacent its top end, said cables being slidable within said eyelets.

17. The stairway of claim 13, wherein said stairway further includes spaced, parallel railings extending upwardly from said steps.

* * * * *